US009335041B2

(12) United States Patent
Marquardt et al.

(10) Patent No.: US 9,335,041 B2
(45) Date of Patent: May 10, 2016

(54) LED LIGHT FIXTURE

(71) Applicant: ABL IP Holding LLC, Conyers, GA (US)

(72) Inventors: Craig Eugene Marquardt, Covington, GA (US); Januk Swarup Aggarwal, Atlanta, GA (US); Xin Zhang, Atlanta (CN); John T. Mayfield, III, Loganville, GA (US); Stephen Barry McCane, McDonough, GA (US); Darryl Lynn Pittman, Greensboro, GA (US); Russell Vern Rouse, Oxford, GA (US)

(73) Assignee: ABL IP Holding LLC, Decatur, GA (US)

( * ) Notice: Subject to any disclaimer, the term of this patent is extended or adjusted under 35 U.S.C. 154(b) by 307 days.

(21) Appl. No.: 13/828,550

(22) Filed: Mar. 14, 2013

(65) Prior Publication Data

US 2013/0294053 A1 Nov. 7, 2013

Related U.S. Application Data

(60) Provisional application No. 61/688,066, filed on May 7, 2012.

(51) Int. Cl.
*F21V 33/00* (2006.01)
*F21K 99/00* (2016.01)
(Continued)

(52) U.S. Cl.
CPC ..... *F21V 33/006* (2013.01); *F21K 9/58* (2013.01); *F21S 8/026* (2013.01); *F21V 7/0008* (2013.01); *F21V 13/10* (2013.01); *F21V 15/013* (2013.01); *F21V 17/005* (2013.01); *F21V 17/10* (2013.01);
(Continued)

(58) Field of Classification Search
None
See application file for complete search history.

(56) References Cited

U.S. PATENT DOCUMENTS 2,887,567 A 5/1959 Dameral
3,058,611 A 10/1962 Chester
(Continued)

FOREIGN PATENT DOCUMENTS

CN 201606808 10/2010
DE 20313899 1/2004
(Continued)

OTHER PUBLICATIONS

Office Action for Canadian Application No. 2,809,555, mailed Jul. 17, 2014 (2 pages).
(Continued)

*Primary Examiner* — Britt D Hanley
(74) *Attorney, Agent, or Firm* — Kilpatrick Townsend & Stockton, LLP

(57) ABSTRACT

A light fixture includes a door frame, the door frame having at least one frame side and a reflector. The edge of the reflector engages a slot in the frame side, which includes at least one LED, to precisely position the reflector and the at least one LED relative to one another. The at least one frame side may also include a reflective kicker for reflecting light from the at least one LED onto the reflector. The reflector may include a semi-specular optical material, which specularly reflects some of the incoming light from the at least one LED and diffusely reflects other of the incoming LED light. The reflector may be collapsible for ease of transportation and shipping; the at least one frame side precisely positions the reflector and at least one LED during assembly and installation.

12 Claims, 7 Drawing Sheets

(51) Int. Cl.

| | |
|---|---|
| ***F21V 17/10*** | (2006.01) |
| ***F21V 13/10*** | (2006.01) |
| ***F21S 8/02*** | (2006.01) |
| ***F21V 7/00*** | (2006.01) |
| ***F21V 15/01*** | (2006.01) |
| ***F21V 17/00*** | (2006.01) |
| *F21V 7/22* | (2006.01) |
| *F21Y 101/02* | (2006.01) |

(52) U.S. Cl.
CPC ..... *F21V 7/22* (2013.01); *F21Y 2101/02* (2013.01); *Y10T 29/4913* (2015.01)

(56) References Cited

U.S. PATENT DOCUMENTS

| | | | | |
|---|---|---|---|---|
| 3,118,620 | A | 1/1964 | Bucek | |
| 3,297,075 | A | 1/1967 | Howell et al. | |
| 3,560,729 | A | 2/1971 | Liberman | |
| 4,517,631 | A | 5/1985 | Mullins et al. | |
| D306,771 | S | 3/1990 | Gecchelin | |
| D311,589 | S | 10/1990 | Benchimol et al. | |
| 5,025,356 | A | 6/1991 | Gawad | |
| 5,051,878 | A | 9/1991 | Ngai | |
| 5,988,829 | A | 11/1999 | Holder | |
| 6,053,624 | A | 4/2000 | Cronk | |
| 6,092,913 | A | 7/2000 | Edwards | |
| 6,164,800 | A * | 12/2000 | McIlwraith | 362/342 |
| 6,561,678 | B2 | 5/2003 | Loughrey | |
| 6,783,263 | B1 | 8/2004 | Cronk | |
| 6,929,382 | B2 | 8/2005 | Kuisma | |
| 7,156,539 | B2 | 1/2007 | Cronk | |
| 7,251,077 | B2 * | 7/2007 | Holmes et al. | 359/599 |
| 7,585,088 | B2 | 9/2009 | Tyson | |
| 7,736,018 | B2 | 6/2010 | Ladstaetter | |
| 7,874,697 | B2 | 1/2011 | Biebel et al. | |
| D633,247 | S | 2/2011 | Kong et al. | |
| 7,914,171 | B2 | 3/2011 | Fabbri et al. | |
| 8,038,314 | B2 | 10/2011 | Ladewig | |
| 8,042,977 | B1 | 10/2011 | Nourishad et al. | |
| D653,376 | S | 1/2012 | Kong et al. | |
| 8,113,680 | B2 * | 2/2012 | O'Brien et al. | 362/147 |
| D664,699 | S | 7/2012 | Nakahira et al. | |
| 8,220,955 | B2 * | 7/2012 | Kwak et al. | 362/217.13 |
| 8,272,763 | B1 * | 9/2012 | Chinnam et al. | 362/249.07 |
| D672,079 | S | 12/2012 | Kong et al. | |
| 8,376,578 | B2 | 2/2013 | Kong et al. | |
| D677,820 | S | 3/2013 | Mayfield, III et al. | |
| 8,408,751 | B2 | 4/2013 | Chen | |
| 8,425,101 | B2 | 4/2013 | Boonekamp | |
| D681,872 | S | 5/2013 | Kong et al. | |
| 8,449,138 | B2 | 5/2013 | Kim et al. | |
| 8,511,848 | B2 | 8/2013 | Gantenbrink | |
| 8,523,389 | B2 | 9/2013 | Holten et al. | |
| 8,534,865 | B2 * | 9/2013 | Kim et al. | 362/225 |
| D696,449 | S | 12/2013 | Boyer et al. | |
| 8,702,268 | B1 | 4/2014 | Rashidi | |
| D707,873 | S | 6/2014 | Boyer et al. | |
| 8,740,410 | B2 * | 6/2014 | Peifer et al. | 362/249.02 |
| 8,807,772 | B2 | 8/2014 | Kim | |
| 8,814,417 | B2 | 8/2014 | Ko et al. | |
| 8,905,575 | B2 | 12/2014 | Durkee et al. | |
| 2009/0129101 | A1 | 5/2009 | Bowden, Jr. et al. | |
| 2009/0168413 | A1 | 7/2009 | Pfund | |
| 2009/0290348 | A1 * | 11/2009 | Van Laanen et al. | 362/249.02 |
| 2010/0284181 | A1 * | 11/2010 | O'Brien et al. | 362/235 |
| 2010/0315813 | A1 * | 12/2010 | Fugerer et al. | 362/235 |
| 2011/0096544 | A1 * | 4/2011 | Nakamura | 362/235 |
| 2011/0103042 | A1 * | 5/2011 | Tirrell et al. | 362/147 |
| 2011/0157883 | A1 | 6/2011 | Fabbri et al. | |
| 2011/0280000 | A1 * | 11/2011 | Kwak et al. | 362/84 |
| 2011/0310614 | A1 | 12/2011 | Budike, Jr. | |
| 2011/0310625 | A1 * | 12/2011 | Mayfield et al. | 362/375 |
| 2012/0002411 | A1 | 1/2012 | Ladewig | |
| 2012/0039067 | A1 | 2/2012 | Kim et al. | |
| 2012/0051041 | A1 * | 3/2012 | Edmond et al. | 362/231 |
| 2012/0140461 | A1 * | 6/2012 | Pickard | 362/225 |
| 2012/0262902 | A1 * | 10/2012 | Pickard et al. | 362/84 |
| 2012/0327650 | A1 * | 12/2012 | Lay et al. | 362/231 |
| 2013/0021777 | A1 * | 1/2013 | Pickard et al. | 362/84 |
| 2013/0021792 | A1 * | 1/2013 | Snell et al. | 362/218 |
| 2013/0039090 | A1 * | 2/2013 | Dau et al. | 362/551 |
| 2013/0176721 | A1 * | 7/2013 | Lu et al. | 362/231 |
| 2013/0176722 | A1 * | 7/2013 | Lay et al. | 362/231 |
| 2013/0208457 | A1 * | 8/2013 | Durkee et al. | 362/218 |
| 2013/0294053 | A1 * | 11/2013 | Marquardt et al. | 362/145 |
| 2013/0294090 | A1 * | 11/2013 | Mayfield et al. | 362/330 |
| 2013/0335962 | A1 * | 12/2013 | Wu et al. | 362/235 |
| 2014/0126197 | A1 * | 5/2014 | Dixon et al. | 362/218 |
| 2014/0233231 | A1 * | 8/2014 | Howe | 362/235 |
| 2014/0268754 | A1 | 9/2014 | Ko | |

FOREIGN PATENT DOCUMENTS

| | | |
|---|---|---|
| DE | 102011090136 | 7/2013 |
| EP | 0206702 A2 | 12/1986 |
| EP | 0206702 A3 | 12/1986 |
| WO | WO 9939131 | 8/1999 |

OTHER PUBLICATIONS

Notice of Allowance for Canadian Application No. CA 2,809,555, mailed Jan. 9, 2015, 1 page.

* cited by examiner

LED LIGHT FIXTURE

RELATED APPLICATION

This application claims the benefit of U.S. Provisional application No. 61/688,066, filed May 7, 2012, entitled "LED light fixture," the disclosure of which is hereby incorporated by reference in its entirety.

FIELD OF THE INVENTION

Embodiments of the invention relate to light-emitting diode ("LED") light fixtures, and more particularly to indirect LED light fixtures in which the LEDs in the fixture are not oriented to emit light directly out of the fixture but rather first onto a reflector that in turn directs the light out of the fixture.

BACKGROUND

LEDs provide many benefits compared to traditional incandescent and fluorescent lighting technologies which make them increasingly attractive for use in lighting applications. For example, LEDs convert much more of the consumed energy to light than, e.g., incandescent light bulbs, and are generally more energy efficient than these traditional light sources. LEDs also last longer than these sources and contain no hazardous chemicals, making them a more environmentally attractive option for lighting needs.

Unlike traditional light sources, however, LEDs provide a point source of light which, if viewed directly, is uncomfortably bright. To address this issue, LED light has been first directed onto a reflector which then reflects the light into the area to be illuminated. Shields have been provided between the LEDs and area to be illuminated to prevent direct viewing of the LED. Such configurations do not, however, provide smooth, aesthetically pleasing light such as that provided by, e.g., incandescent light bulbs.

In addition, the light distribution from an LED light fixture incorporating a reflector will vary from one fixture to the next if the relative position between the LEDs and the reflector cannot be consistently maintained, which would likely occur if the fixture were assembled at the point of installation. This would be problematic, e.g., in a large room where several LED light fixtures are utilized and where inconsistent light distribution from one fixture to the next would be readily apparent. To ensure consistency, LED light fixtures have thus been assembled at the point of manufacture and shipped as a complete unit. Fully assembled fixtures, however, require more packaging, resulting in higher transportation costs and undesirable waste of packaging materials.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter.

The subject matter should be understood by reference to the entire specification of this patent, all drawings and each claim.

In one embodiment, a light fixture includes a door frame, the door frame having at least one frame side and a reflector having an edge. The least one frame side may include a slot formed in the at least one frame side, a mounting surface, and at least one LED mounted on the mounting surface. The edge of the reflector engages the slot in the frame side to precisely position the reflector and the at least one LED relative to one another.

In some embodiments, the at least one frame side further includes an angled side edge extending from a bottom edge and a kicker for reflecting light from the at least one LED onto the reflector, the kicker supported by the angled side edge of the at least one frame side. Engagement of the reflector in the slot of the at least one frame side precisely positions the reflector, the at least one LED and the kicker relative to one another. The at least one frame side may also include a mounting ledge extending from the angled side edge, wherein the kicker is positioned on the mounting ledge.

In certain embodiments, the door frame further includes at least one frame end attached to the at least one frame side, while in some embodiments the door frame includes two frame sides and two frame ends, the frame sides opposing each other and the frame ends opposing each other, the door frame forming an opening in which the reflector is located.

The door frame may include at least one aperture for receiving a fastener for attaching the at least one frame side to the at least one frame end.

In an embodiment the reflector includes a reflector substrate and a semi-specular optical material positioned on the reflector substrate. The semi-specular optical material may include a specular reflective film and a diffuse coating provided on the specular reflective film, wherein the specular reflective film is located between the reflector substrate and the diffuse coating. The reflector substrate may be formed from a material selected from the group consisting of optical grade polyester, polycarbonate, acrylic, prefinished anodized aluminum, prefinished anodized silver, painted steel and aluminum.

In some embodiments, the specular reflective film has a surface reflectivity of between about 96-100%. In other embodiments the specular reflective film has a surface reflectivity of between about 98.5-100%.

In certain embodiments one or more of the diffuse coating, specular reflective film and reflector substrate are enhanced or altered. The enhancement or alteration may include one or more of roughening, patterning, structuring and hammertone, which can be on the order of ¼ micron to ½ inch.

In an embodiment a method for assembling a light fixture includes inserting a first side edge of a reflector into a slot of a first frame side, inserting a second side edge of the reflector into a slot of a second frame side, and attaching one frame end to the first frame side and another frame end to a second frame side to form a door frame. Each of the frame sides includes at least one LED mounted thereon. Insertion of the first edge of the reflector into the slot of the first frame side and insertion of the second edge of the reflector into the slot of the second frame side precisely positions the reflector relative to the at least one LED of the first frame side and the at least one LED of the second frame side.

In some embodiments the method includes removing the frame ends from the first frame side and the second frame side, wherein removal of the frame ends allows the reflector to be collapsed to a reduced height for improved shipping or transportation efficiency.

In other embodiments the method includes causing the height of the reflector to increase prior to inserting the first and second side edges of the reflector into the slot of the first and second frame sides.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

With reference to FIGS. 1-4, in one embodiment a light fixture 100 generally includes a door assembly 200 that is mounted onto a housing 400 positioned in a ceiling 500. In an embodiment the light fixture 100 may be a recessed light fixture.

Figure 1:
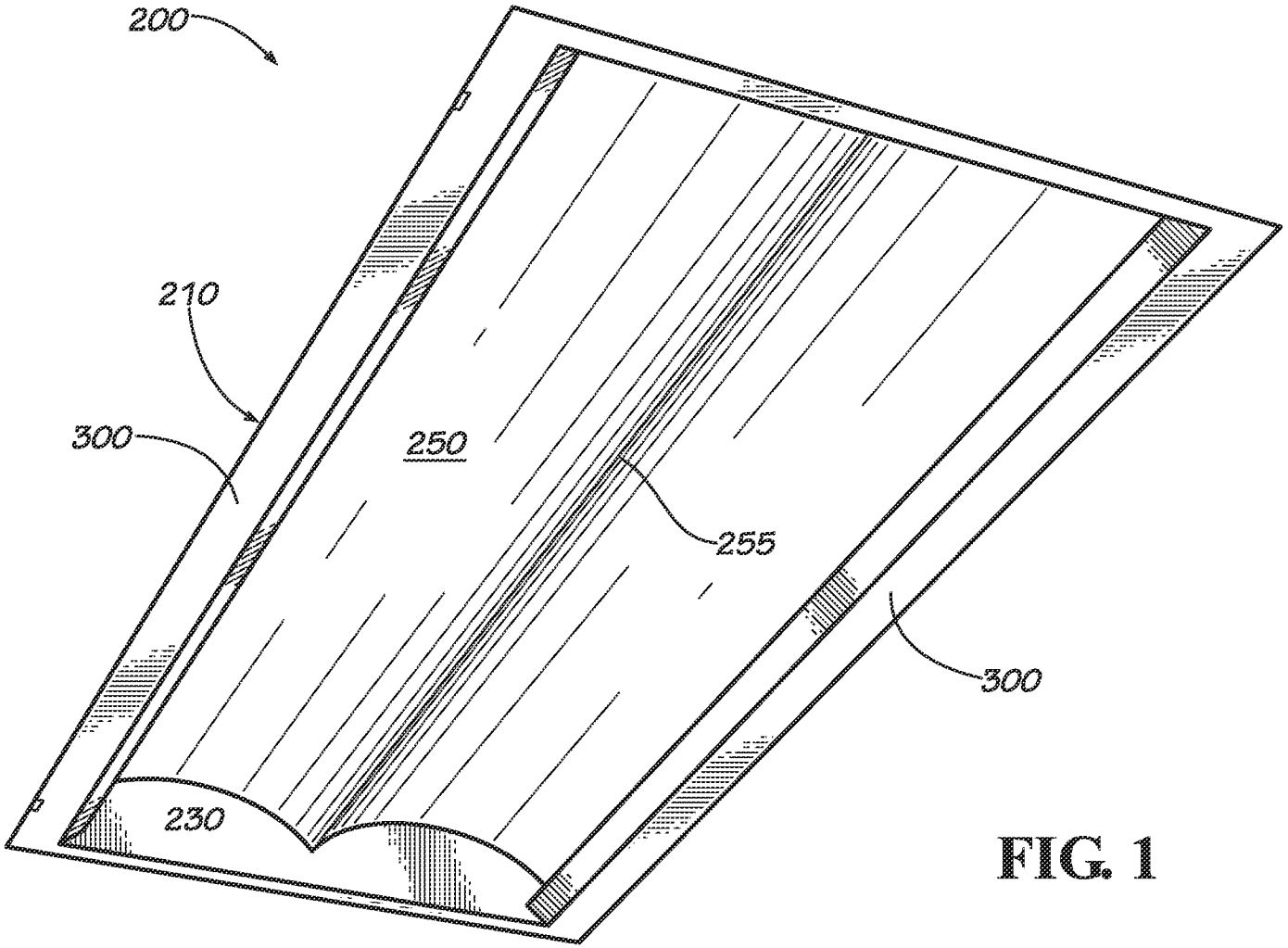
FIG. 1 is a bottom perspective view of a light fixture according to an embodiment of the invention.
Figure 2:
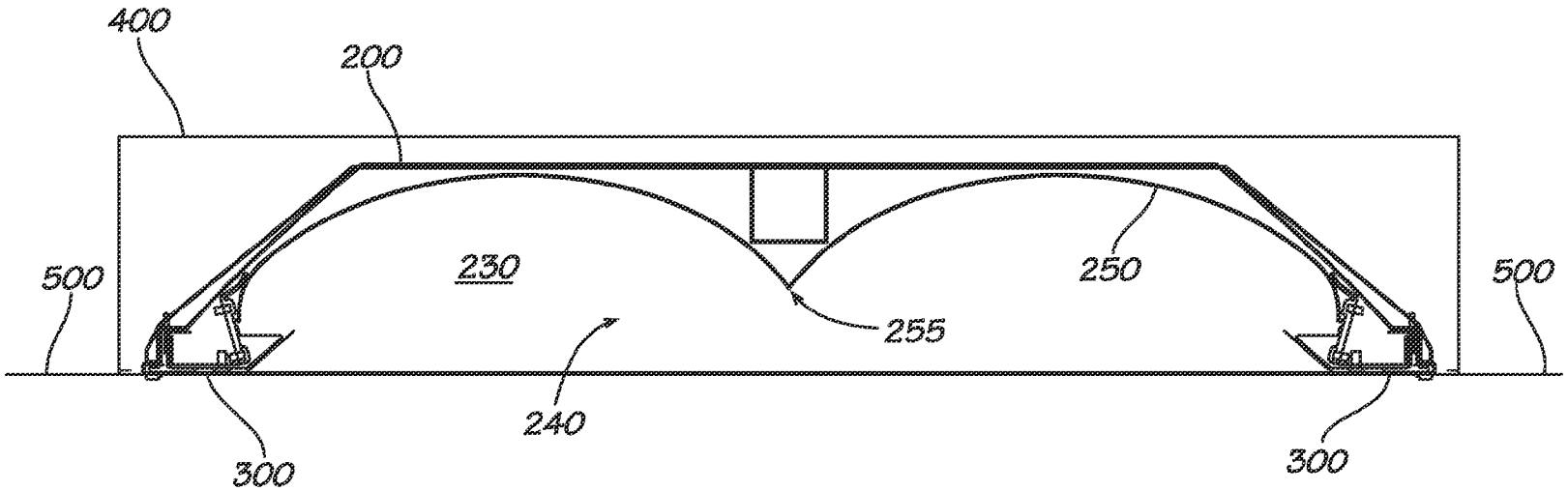
FIG. 2 is an end cross-sectional view of a light fixture according to the embodiment of FIG. 1.
Figure 3:
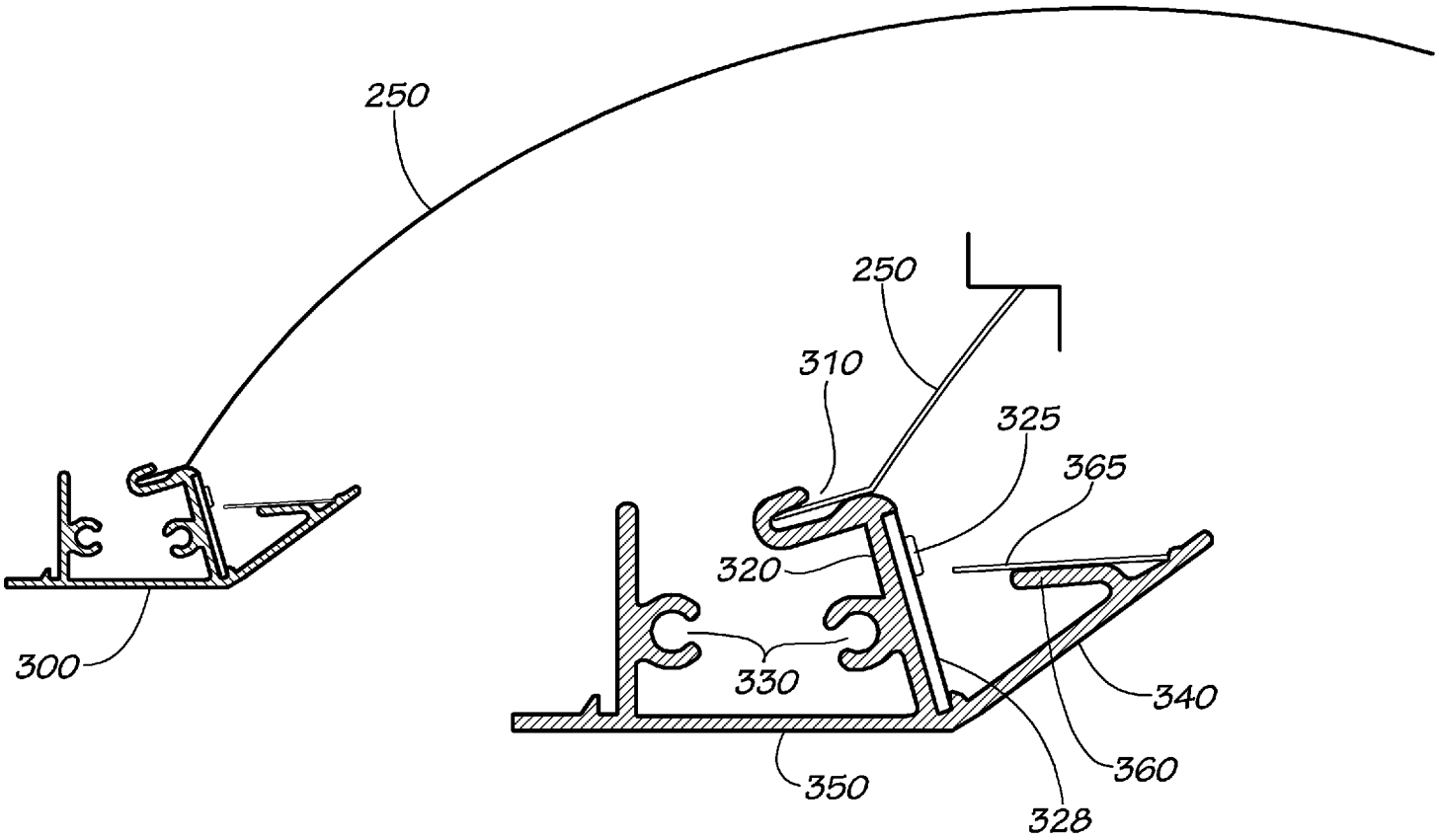
FIG. 3 is a partial end cross-sectional view of a light fixture according to the embodiment of FIG. 1.
Figure 4A:
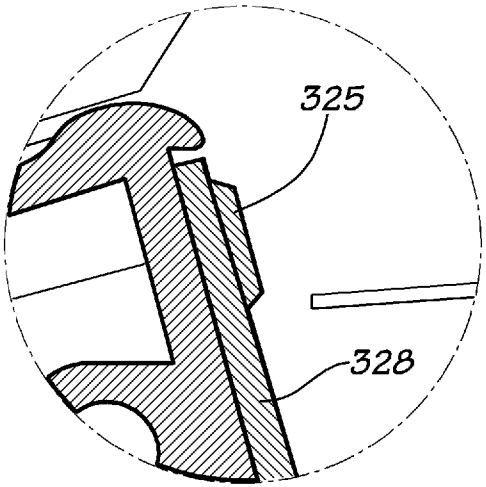
FIG. 4 is a partial end cross-sectional view of the light fixture according to the embodiment of FIG. 1 showing light distribution characteristics.
Figure 4:
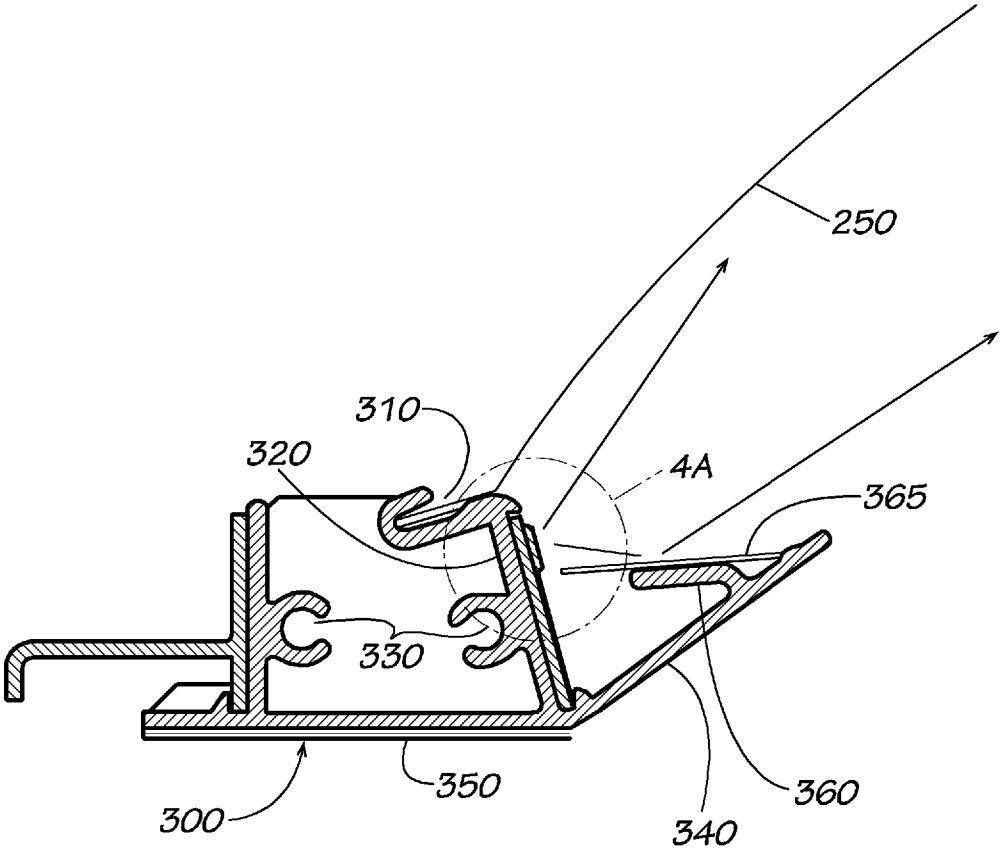

The door assembly 200 generally includes a door frame 210 formed by two frame sides 300 and two frame ends 230 (only one frame end is visible in FIG. 1). Collectively, the frame sides 300 and frame ends 230 define an opening 240. The door frame 210 can be of any dimensions and is not limited to the rectangular-shaped frame shown in FIG. 1. A reflector 250 is positioned within the door frame 210 to span the opening 240 of the door frame.

Each frame side 300 supports various components of the door assembly 200 and provides a rigid construct to ensure that such components remain oriented properly relative to each other. In certain embodiments, one or both frame sides 300 may include the following features, described in more detail below: a slot 310, a mounting surface 320 for one or more LEDs 325 (shown mounted on printed circuit board 328), one or more apertures 330, an angled frame side edge 340, a bottom edge 350, and a mounting ledge 360 for a reflective kicker 365.

The slot 310 on each frame side 300 receives an edge of the reflector 250 to retain the reflector 250 on the door assembly 200 and ensure that the reflector 250 retains its intended shape and relative positioning to the LEDs 325 to reflect light from the LEDs 325 as desired (described in more detail below).

The mounting surface 320 for the printed circuit board 328 precisely positions the one or more LEDs 325 on the board 328 at the proper angle such that they direct light onto the reflector 250 at the desired angle(s). The printed circuit board 328 may be mounted directly on the mounting surface 320 or a thermally insulative or other material may be interposed between the mounting surface 320 and the printed circuit board 328.

The apertures 330 receive screws or other fasteners (not shown) to attach the frame ends 230 to the frame sides 300 to form the door frame 210.

The angled frame side edge 340 extends upwardly from the bottom edge 350 and shields the one or more LEDs 325 from direct view when the light fixture 100 is installed in the ceiling 500 and prevents light emitted by the one or more LEDs 325 from being emitted directly out of the light fixture 100 (i.e., so that almost all of the light that ultimately escapes the light fixture 100 does so by reflection off of the reflector 250).

The mounting ledge 360 extends from the angled frame side edge 340 to support and precisely locate a reflective kicker 365 that reflects and thereby re-directs light from the one or more LEDs 325 onto the reflector 250.

The frame sides 300 may be formed (such as by extrusion) of a metallic (e.g., aluminum), polymeric or other material that conducts heat away from the one or more LEDs 325 mounted on the frame sides 300. Although shown in the figures as integrally formed, it will be recognized that various portions of frame side 300 could be formed separately and then connected to each other by known attachment or fastening methods (e.g., adhesives, physical fasteners including but not limited to screws and bolts, snap-fittings, etc.).

The frame sides 300, with some or all of the associated features discussed above, precisely locate and retain in the desired relative positions the reflector 250, one or more LEDs 325 and kicker 365 to allow for consistency in light distribution from one light fixture installation to the next.

Moreover, in some embodiments all of the fixture parts (light source(s), reflector(s), heat sink, etc.) are supported by the frame sides 300 of the door assembly 200. Thus, it is possible easily to retrofit the door assembly 200 into an existing housing 400 through the use of brackets that span the ends of the housing and engage the door frame, such as the frame ends of the door frame. U.S. Patent Publication No. US2009-0207603-A1, the disclosure of which is incorporated by referenced herein in its entirety, describes an example of brackets that could be adapted to retrofit the door assembly 200 into existing housings 400.

Other features relate to methods for improving the shipping efficiency of the light fixture 100. As explained above, the reflector 250 and frame ends 230 may be attached to the frame sides 300 and may thus be removable therefrom. In some embodiments, the reflector 250, frame ends 230 and frame sides 300 are packaged and shipped in disassembled form. When disassembled, the reflector 250 may be collapsible such that it can be compressed (i.e., by pushing down on the reflector 250 or allowing the center of the reflector to naturally drop down), which reduces the height of the reflector 250 for shipping, allowing for a thinner shipping container and thus improved shipping efficiency. To assemble the light fixture 100, the consumer removes the reflector 250, frame sides 300 and frame ends 230, inter alia, from the shipping container. The reflector 250 either returns to its original shape (e.g., by spring action due to inherent tension in the reflector 250) or the consumer shapes the reflector by installing it into the slot 310 on each frame side 300 and attaching the frame ends 230 to the frame sides 300 as described above. As explained above, once installed, the positioning of the reflector 250 relative to the frame sides 300 (and thus to the one or more LEDs 325) is precisely determined.

Embodiments of the reflector 250 used in the door assembly 200 utilize a reflective optical material and a reflector geometry to realize the benefits of both a specular reflective surface and diffuse reflective surface. More specifically, the reflector 250 is designed to reflect light in a largely diffuse manner to impart a uniform glow to the luminous surfaces of the fixture, but is also able to control the directionality of some of the light to create an engineered photometric distribution without hotspots and light source images.

Figure 5:
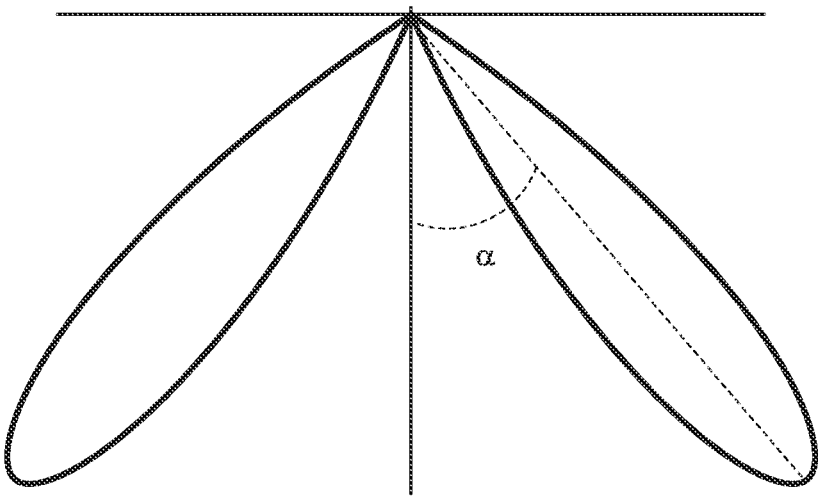
FIG. 5 is a polar plot showing output light distribution from a reflector having a specular surface.

Specular surfaces are ones in which reflected light leaves the surface at the same angle to the surface normal as the incident light. The output light distribution from an example reflector using this type of reflection is represented by the polar plot of FIG. 5. If such a surface is relatively smooth over an area, the reflected rays can form an image. Examples of materials with such surfaces are bathroom mirrors, polished granite countertops, etc. Specular surfaces can be made to reflect in quasi-random directions by patterning the surface with a quasi-random shape. Examples of such finishes include hammer-tone, patterned microstructures, holographic microstructures, etc.

Figure 6:
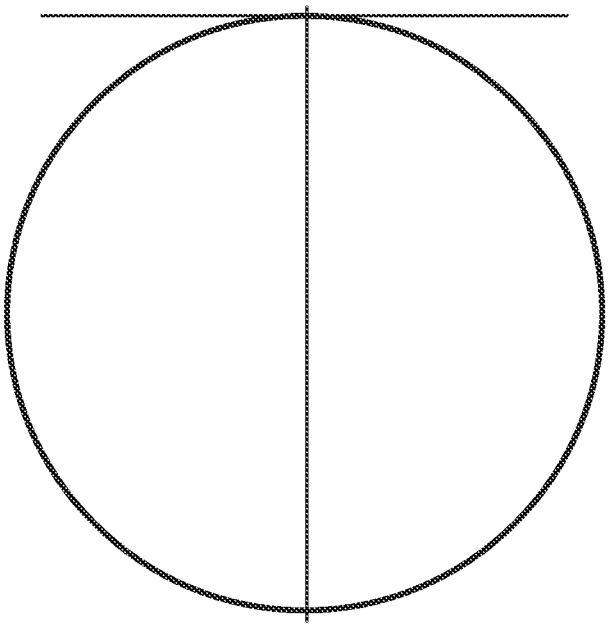
FIG. 6 is a polar plot showing output light distribution from a reflector having a diffuse surface.

Diffuse surfaces are ones in which reflected light leaves the surface in all directions equally, regardless of the direction of the incident light. The output light distribution from an example reflector using this type of reflection is represented by the polar plot of FIG. 6. These surfaces do not reflect images, but also do not allow for control of where the reflected light will go. Examples of materials with such surfaces are matte paper, carpet, etc.

Real materials and surfaces are usually not ideal and so the reflection characteristics are more complex. Diffuse materials often have relatively smooth surfaces and may have a specular component to the reflection (e.g. glossy magazine paper or glossy paint). Objects can be imaged in such surfaces, albeit with potentially low contrast. Likewise, a seemingly smooth specular surface may reflect light with some diffuse component, potentially reducing to what extent the reflected light can be controlled. Diffuse surfaces with a significant specular component are sometimes termed "semi-specular" and specular surfaces with a significant diffuse component are sometimes termed "semi-diffuse."

In luminaire optics, it is often desirable to make a source seem less bright by expanding the luminous area. At the same time, it is often desirable to control where the light goes to maximize the effectiveness of the light in the target application (e.g. minimize hot-spots, illuminate vertical surfaces in racks, etc.). With traditional reflective materials, it is often not possible to completely obscure the light source (typically using diffuse surfaces) while retaining control of the light distribution (typically using specular surfaces).

If the reflector described herein was completely diffuse, then near the LEDs the reflector would appear much more luminous than areas further away from any LEDs. If the reflector was completely specular, then the output light would be directional, but the reflector would have images of some LEDs "flashed" at any given observation position while the rest of the reflector would appear dark.

Figure 7:
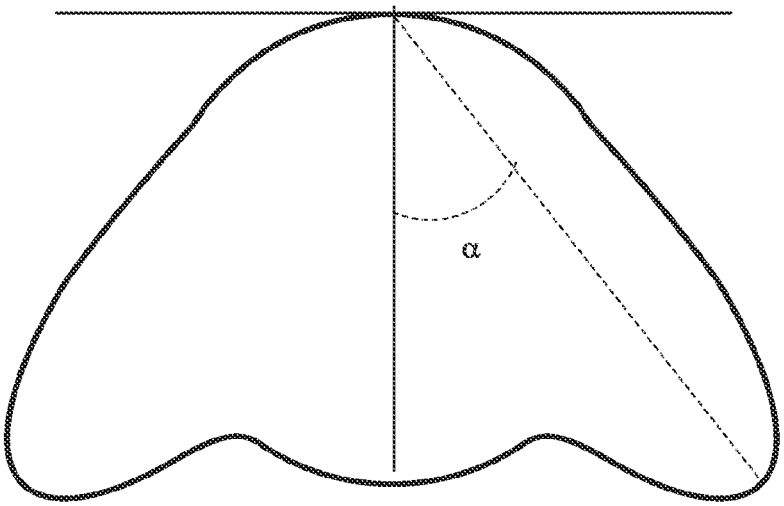
FIG. 7 is a polar plot showing output light distribution from a reflector having a hybrid specular/diffuse surface.

A reflector 250 according to some embodiments of the invention include both a reflective optical material and a reflector geometry that collectively enable the reflector to impart a diffuse appearance to its surface while at the same time controlling some of the reflected light to create a tailored distribution. Such a hybrid distribution is represented by the polar plot of FIG. 7, which represents some of the light being diffusely reflected and other of the light being specularly reflected.

Embodiments of the reflector 250 include a reflector substrate 370 provided with a semi-specular optical material 375 that forms the optical surface of the reflector 250. See generally FIG. 8.

The reflector substrate 370 may be made of any suitable material, including polymeric materials (e.g., optical grade polyesters, polycarbonates, acrylics, etc.) or metallic materials (e.g., prefinished anodized aluminum (e.g. Alanod Miro), prefinished anodized silver (e.g. Alanod Miro Silver), painted steel or aluminum, etc.). Regardless of the substrate material, the semi-specular optical material 375 may be provided on the reflector substrate 370. In some embodiments, the semi-specular optical material 375 is adhered to the substrate by an adhesive 380. In other embodiments, the semi-specular optical material 375 may be extruded onto the reflector substrate 370. The semi-specular optical material 375 may be provided on the reflector substrate 370 either prior or subsequent to bending or thermoforming the reflector substrate 370 into the desired reflector geometry.

Figure 8:
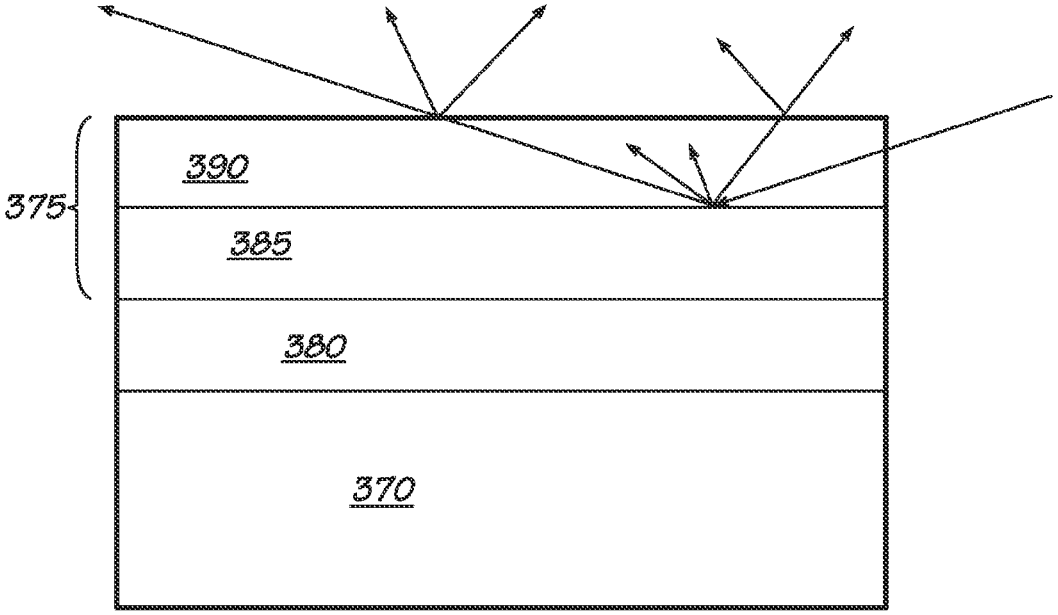
FIG. 8 is a cross section of a reflector according to an embodiment of the invention.

In some embodiments, the semi-specular optical material 375 is a composite material formed of a specular reflective film 385 coated with a diffuse coating 390. As seen in FIG. 8, the diffuse coating 390 is slightly transmissive so that some of the light hitting the diffuse coating 390 is diffusely reflected by the diffuse coating 390 whereas other of the light hitting the diffuse coating 390 penetrates through to the specular reflective film 385 underneath the diffuse coating 390, where it is specularly reflected. One embodiment of a suitable semi-specular optical material 375 having a specular reflective film 385 coated with a diffuse coating 390 is 3M's Semi-Specular Film on Metal, which includes a polymeric specular film (Enhanced Specular Reflector or ESR) provided with a diffuse coating. The specular reflective film 385 should have an extremely high surface reflectivity, preferably, but not necessarily, between 96%-100%, inclusive, and more preferably 98.5-100%, inclusive.

The bulk and surface scattering characteristics of the optical materials and surfaces can be varied such that the resulting distribution of the reflected light is reflected with a bias towards the forward direction, but no images are formed. In some embodiments, the exposed surface of the diffuse coating 390 of the semi-specular optical material 375 is enhanced or otherwise altered (e.g., roughened, provided with surface or other patterns, structured, hammer-tone, etc.). In certain embodiments, one or more of the semi-specular optical material 375 (including the specular reflective film 385 and/or the diffuse coating 390) and the reflective substrate 370 is enhanced or otherwise altered.

In some embodiments, the surface enhancements are provided on the order of ¼ micron to ½ inch. In other embodiments, the surface enhancements are provided on the order of ½ micron to 100 microns, or even 1 micron to 10 microns. In yet other embodiments, the surface enhancements are provided on the order of ½ micron to 10 microns, or even 10 microns to 100 microns or 100 microns to ¼ inch.

Figure 9:
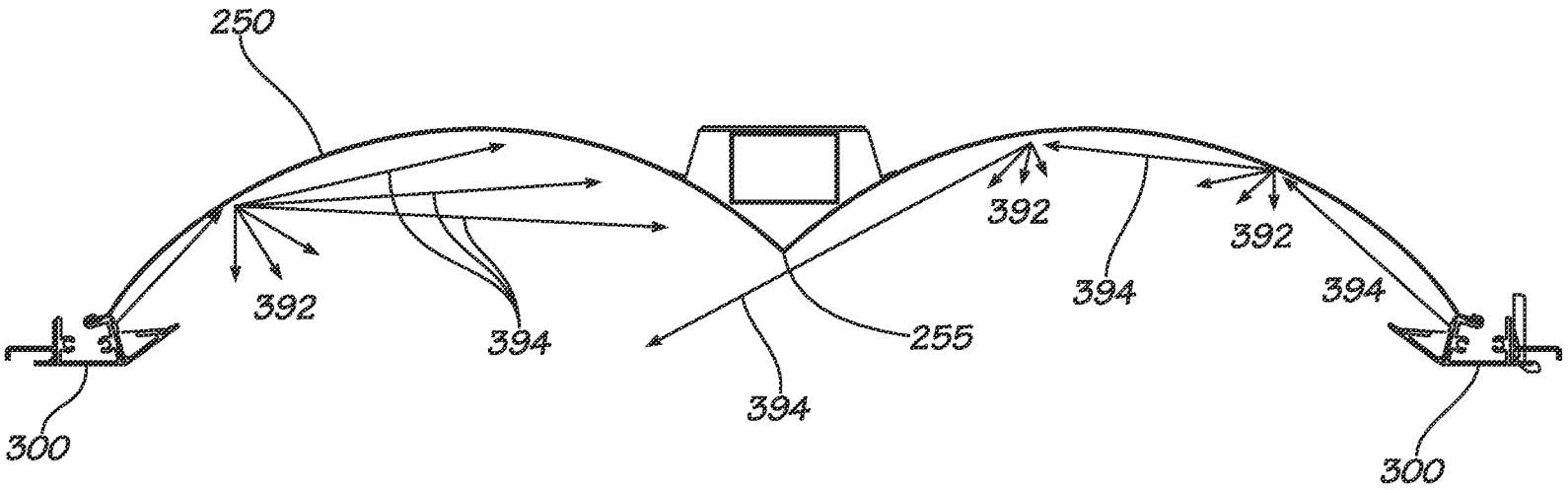
FIG. 9 is an end cross-sectional view of a reflector according to an embodiment of the invention showing light distribution characteristics.

As seen in FIG. 9, with the semi-specular optical material 375 near the one or more LEDs 325 only some of the light is reflected diffusely 392. The rest of the light is moved forward via "forward transport" 394 (described below) in a controlled manner and interacts again with the inner part of the reflector 250 (i.e., towards the apex of the reflector 255) where it is reflected into the desired beam. Since this second reflection also has a diffuse component, the whole reflector 250 has luminance from any given observation position. If the forward light was from specular reflection only, then from a given observation position, there would be sharp transitions in the luminance of the reflector surface across the reflector. At worst this would look like images of the one or more LEDs 325 and at best it would look like a hotspot on the reflector 250. By using a less defined "forward-transport" reflection, these hotspots are reduced and the transition between high and low luminance areas across the reflector are blended together. If done correctly, the transitions can become nearly indistinguishable from areas where the luminance is from the diffuse component only.

For the purposes of this description, when a surface is illuminated from a given direction (defined as east), "forward-transport" is the amount of reflected light in the western quarter-sphere minus the amount of reflected light in the eastern quarter-sphere all divided by the total amount of reflected light. With this definition, a purely specular material will have a transport ratio of 1 and a purely diffuse material will have a transport ratio of 0.

The number of times that light is reflected by the reflector 250 (and thus the tailoring of the light's distribution) is also dependent on the geometry of the reflector, particularly the reflector's radius of curvature, which may range between 9-14" inclusive and more particularly around 11.5" in some embodiments. In some embodiments, the curvature is a free-form surface with a plurality of radii of curvature. Given the indirect nature of light emission from the fixture, the light will always reflect at least once before exiting the fixture. The light may reflect any number of times before exiting the fixture, but typically will reflect between 1 to 3 times.

The size and geometry of the apex 255 of the reflector 250 (defined herein as the area where the two curved portions of the reflector 250 meet) also dictates how the light is reflected by the reflector 250. While the Figures illustrate a reflector 250 having a relatively pointed apex 255, the apex 255 can have a myriad of other geometries, including, but not limited to, those disclosed in PCT Application PCT/US2011/24922 (Publication No. WO 2011/100756 A1), the disclosure of which is incorporated by referenced herein in its entirety, in which the optical elements described therein can obviously assume more of a linear nature depending on the dimensions of the reflector 250. The apex 255 of the reflector 250 may be recessed within the door frame 210 or terminate coplanar with the door frame 210. In other embodiments, the apex 255 may extend below the plane of the door frame 210 (and thus the plane of the ceiling 500).

The reflector described herein is by no means limited to use in the recessed fixture illustrated in the Figures. Rather, the reflector can be adapted for use in any type of indirect lighting fixture. For example, the reflector may be installed directly into a ceiling without the use of a housing, e.g., by installing it directly onto the T-grid of a ceiling.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A light fixture comprising:

(i) a door frame comprising a first frame side, a second frame side, and two frame ends, wherein the first and second frame sides oppose each other and the two frame ends oppose each other to define an opening and wherein the first and second frame sides each comprise:
a slot formed in the frame side;
a mounting surface; and
at least one LED mounted on the mounting surface; and (ii) a reflector located within the opening and comprising a first side edge and a second side edge, wherein the first side edge of the reflector engages the slot of the first frame side and the second side edge of the reflector engages the slot of the second frame side to precisely position the reflector relative to the at least one LED of the first frame side and the at least one LED of the second frame side.

2. The light fixture of claim 1, wherein each of the first and second frame sides further comprises:
an angled side edge extending from a bottom edge; and
a kicker for reflecting light from the at least one LED onto the reflector, the kicker supported by the angled side edge of the frame side,
wherein engagement of the first side edge of the reflector in the slot of the first frame side and engagement of the second side edge of the reflector in the slot of the second frame side precisely positions the reflector relative to the at least one LED and the kicker of the first frame side and the at least one LED and the kicker of the second frame side.

3. The light fixture of claim 2, wherein each of the first and second frame sides further comprises a mounting ledge extending from the angled side edge, wherein the kicker is positioned on the mounting ledge.

4. The light fixture of claim 2, wherein each of the first and second frame sides further comprises at least one aperture for receiving a fastener for attaching the first and second frame sides to the two frame ends.

5. The light fixture of claim 1, wherein the reflector comprises a reflector substrate and a semi-specular optical material positioned on the reflector substrate.

6. The light fixture of claim 5, wherein the semi-specular optical material comprises a specular reflective film and a diffuse coating provided on the specular reflective film, wherein the specular reflective film is located between the reflector substrate and the diffuse coating.

7. The light fixture of claim 6, wherein the reflector substrate is formed from a material selected from the group consisting of optical grade polyester, polycarbonate, acrylic, prefinished anodized aluminum, prefinished anodized silver, painted steel and aluminum.

8. The light fixture of claim 6, wherein the specular reflective film has a surface reflectivity of between about 96-100%.

9. The light fixture of claim 2, wherein each of the first and second frame sides are integrally formed from extruded aluminum.

10. A method for assembling a light fixture, the light fixture comprising (i) a door comprising a first frame side, a second frame side, and two frame ends and (ii) a reflector having a height and comprising a first side edge and a second side edge, wherein the first and second frame sides each comprise:
a slot formed in the frame side;
a mounting surface; and
at least one LED mounted on the mounting surface wherein the method comprises:

a. inserting the first side edge of the reflector into the slot of the first frame side;

b. inserting the second side edge of the reflector into the slot of the second frame side; and c. attaching one of the frame ends to the first frame side and the other of the frame ends to the second frame side to form the door frame, wherein insertion of the first side edge of the reflector into the slot of the first frame side and insertion of the second side edge of the reflector into the slot of the second frame side precisely positions the reflector relative to the at least one LED of the first frame side and the at least one LED of the second frame side.

11. The method of claim 10, further comprising removing the frame ends from the first frame side and the second frame side, wherein removal of the frame ends allows the reflector to be collapsed to a reduced height for improved shipping or transportation efficiency.

12. The method of claim 10, further comprising causing the height of the reflector to increase prior to inserting the first and second side edges of the reflector into the slot of the first and second frame sides.

* * * * *